United States Patent [19]

Huston et al.

[11] 3,932,900

[45] Jan. 20, 1976

[54] TOILET WATER SAVER

[76] Inventors: Victor Huston; James R. Huston, both of 2363 S. Dangle, Muskegon, Mich. 49442

[22] Filed: Sept. 16, 1974

[21] Appl. No.: 506,032

[52] U.S. Cl. ..... 4/63; 4/55; 4/62; 4/63; 4/56

[51] Int. Cl.[2] ..... E03D 1/34

[58] Field of Search ..... 4/63, 55, 53, 56, DIG. 1, 4/62, 67 A, 57 P

[56] References Cited

UNITED STATES PATENTS 362,764 5/1887 McHugh ..... 4/63

2,817,849 12/1957 Hewitt ..... 4/63 X

*Primary Examiner*—Richard E. Aegerter
*Assistant Examiner*—Larry Jones
*Attorney, Agent, or Firm*—Marden S. Gordon

[57] ABSTRACT

A weighted float device supported on a rod to be connected to the conventional float associated with a toilet flush mechanism and projecting downwardly from the float into the tank water and including compensation adjustment weights thereon for adjusting the amount of floatation of the device to compensate for differences in water pressure and weights of conventional type floats.

2 Claims, 4 Drawing Figures

TOILET WATER SAVER

BACKGROUND OF THE INVENTION

1. Field of the Invention

This invention relates generally to toilet flush mechanisms and more particularly to a novel and improved device for saving toilet water during each flushing operation resulting in a great conservation of water resources.

2. Description of the Prior Art

Various types of conventional toilet flush mechanisms are known in the prior art, all of these devices functioning in the same general manner as to having a float mechanism operational with the level of the water height to control the flow of incoming water to the tank, and having a flush valve at the bottom of the tank and controlling the water discharged from the tank to the toilet bowl for flushing purposes. Due to the structure and style of the tanks, and as manufacturers must make the tanks to operate properly in areas throughout the country having different water pressures and sewage flush requirements, the tank is of an overly large size with the volume of water contained therein and utilized during each flushing operation being much more than required such that the manufacturers are always on the safe side to be sure that sufficient water is present for the flushing operation.

In view of the countrywide attempt at conservation of water resources, it would be desirable to provide a device readily attached to toilet flush mechanisms without requiring mechanical alteration thereof and which could be individually adjusted for each specific usage of the toilet tank to compensate for the local water pressure such that only the exact amount of water needed for proper flushing in the particular area is utilized, thus resulting in a great saving and conservation of water resources.

SUMMARY OF THE INVENTION

The present invention recognizes the deficiencies and disadvantages of presently available toilet flush mechanisms and the wastefulness of water resources as to the use of excessive water during each flushing operation of a toilet, and provides a novel solution thereto in the form of a flotation device adapted to be readily attached to the float support arm of a conventional toilet mechanism with the device having a number of compensating weights which may be affixed to or removed from the device to compensate the flotation buoyancy thereof in cooperation with the float to reduce the amount of water utilized during each flushing operation of the toilet.

It is estimated that the average person flushes a toilet between five and six times daily, and that the present device would result in a savings of approximately nine gallons of water a day per person. Thus, in an average family of four persons this would amount to about 36 gallons of water a day, which, over a year's time, would result in a water conservation saving of about 13,140 gallons of water. In a city having a population of one million people, this would amount to a water savings of approximately 3,285,000,000 gallons of water a year which are saved and which also do not pass through the city sewage plant or require filtering and chlorination thereof before use, this resulting in still greater savings of the cost of operating water and sewage facilities of the city.

It is a feature of the present invention to provide a toilet water saver device which is relatively simple in its construction and which therefore may be readily manufactured at a relatively low cost and by simple manufacturing methods such that it may be retailed at a sufficiently low price to encourage widespread use thereof.

A further feature of the present invention provides a toilet water saver device which is possessed of few parts and which therefore is unlikely to get out of order.

Still a further feature of the present invention provides a toilet water saver device which is of a rugged and durable construction and which therefore may be guaranteed by the manufacturer to withstand many years of intended usage.

Still yet a further feature of the present invention provides a toilet water saver device which is easy to use and reliable and efficient in operation and which may be connected to the conventional flush mechanism without requiring any special tools or expertise on the part of the homeowner.

Yet still a further feature of the present invention provides a toilet water saver which may, in its entirety, be manufactured and installed as part of the original equipment of the toilet flush mechanism, or which may be readily attached to a toilet flush mechanism later as an accessory item, and which is readily adjustable by a homeowner to achieve the desired intended purposes.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
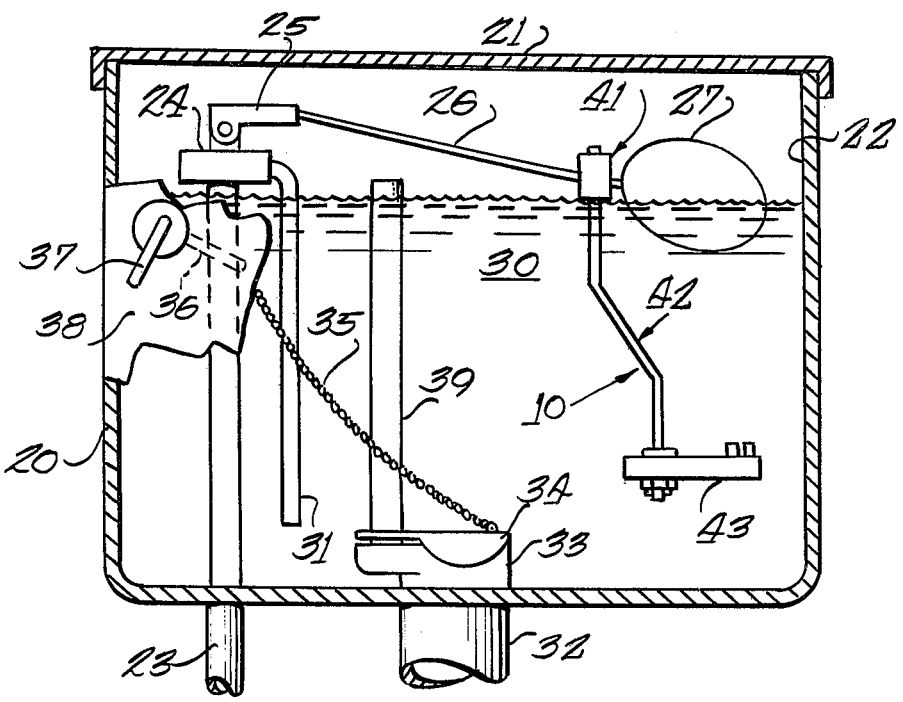
FIG. 1 is a front elevational view of a toilet tank partially broken away to illustrate interior details thereof and having the device of the present invention attached thereto.
Figure 2:
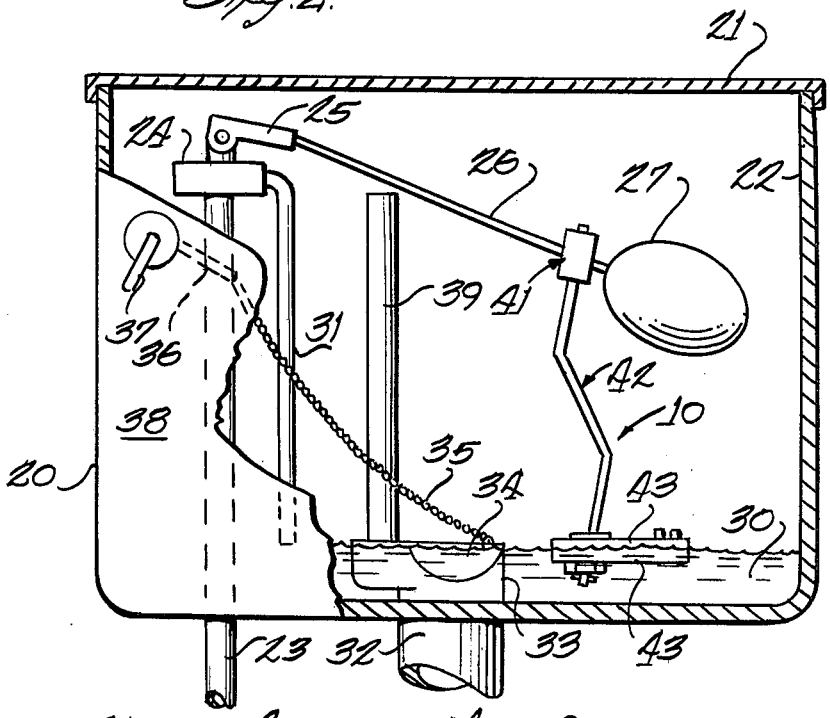
FIG. 2 is a view similar to FIG. 1 but with the toilet tank illustrated after having been flushed, the valve being closed, and the water reserve discharged.
Figure 3:
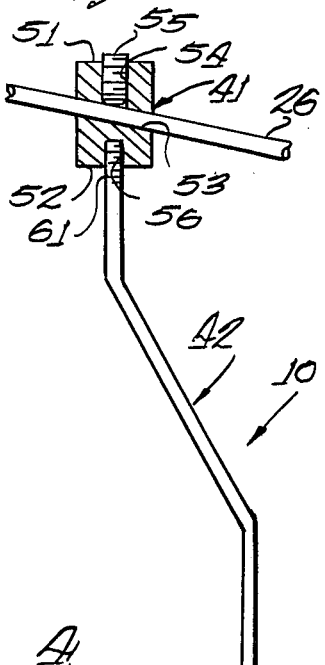
FIG. 3 is a front elevational view of the water saver device of the invention with elements thereof in partial cross-section to illustrate details thereof.
Figure 3:
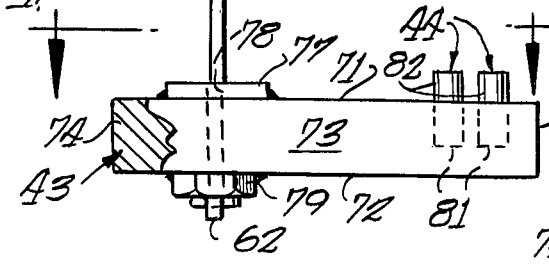
Figure 4:
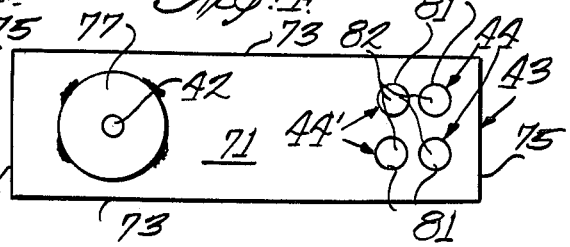
FIG. 4 is a cross-sectional view taken along Line 4—4 of FIG. 3.

Referring now to the drawings in detail there is illustrated a preferred form of a water saver device constructed in accordance with the principles of the present invention and which is designated generally in its entirety by the reference numeral 10.

The water saver device 10 is intended for use with conventional type water flush mechanisms, and for purposes of illustration there is illustrated a conventional type hollow rectangular box-like toilet tank 20 having a removable cover 21 and a water containing compartment 22 therein, and water is supplied to the compartment 22 through a water line 23 extending through the bottom surface of the tank and having a water inlet fill valve 24 mounted on the top thereof and which is actuated by pivotal movement of an actuating arm 25 having one end of a rod 16 connected thereto and projecting therefrom and terminating in a conventional hollow float 27 in a conventional manner. Water 30 is discharged into the compartment 22 by means of inlet pipe 23 through valve 24 and inlet pipe 31.

A flush pipe 32 has one end connected to the toilet bowl (not shown) with the opposite end extending through the bottom surface of the tank 20 and terminating in a flush valve seat member 33 having a valve member 34 pivotally associated therewith and operable by means of a flexible chain 35 extending from the valve member upwardly to an arm 36 rotatably associated with a handle 37 extending out of the front surface 38 of the tank 20, rotation of the handle tightening the chain 35 and pivoting the valve member 34 away from valve seat 33 to permit water 30 to be flushed through flush pipe 32.

A vertical overflow pipe 39 projects upwardly from the flush valve seat member 33 to a level above the normal level of the water 30 and is adapted to receive a flow of water thereinto should the water level accidentally extend above the normal water level, this preventing any overflow of the water from the tank 20.

The device 10 consists of a holder 41 preferably manufactured of non-corrosive aluminum material, a support rod 42, a float body member 43, and a plurality of compensating adjustment weights 44.

The holder 41 is of a generally rectangular configuration having a top surface 51 and a bottom surface 52 with an open face channel forming slot 53 extending through one side thereof adapted to receive a portion of float supporting rod 26 therein. An interiorly threaded bore 54 extends through top end 51 and terminates at slot 53 and receives therein a threaded set screw 55 adjustable to engage rod 26 passing through slot 53 to retain the connector 41 affixed thereto. A cylindrical threaded bore 56 extends through the bottom end 52 and receives therein threaded end 61 of rod 42 which extends outwardly therefrom and has its opposite end 62 secured to float 43.

The float 43 is of a rectangular configuration providing buoyancy and flotation properties thereto, the float having a top surface 71, a bottom surface 72, opposed side walls 73, and opposed end walls 74 and 75.

Adjacent end 74 on top surface 71 there is secured thereto a circular washer 77 provided with an aperture 78 extending centrally therethrough, the aperture axially aligned with the threaded aperture of nut 79 affixed to the float bottom surface 72. The end 62 of rod 42 extends through aperture 78 and is threadedly received by nut 79.

Disposed in top surface 71 adjacent end surface 75 are a plurality of recesses 81 each adapted to receive therein an elongated cylindrical weight 82.

In operation, the device 10 is affixed to the float support rod 26 as shown, and weights 82 are either inserted into or removed from the recesses 81 to make compensating adjustments to the flotation and buoyancy characteristics of the float body 43 to adjust the amount of flotation to compensate for the differences in local water pressures and flushing requirements dependent upon the exact area and location in which the tank 20 is located and on which the device is to be utilized.

When the toilet is flushed by operation of handle 37 opening flush valve 34 from valve seat 33, inlet valve 24 would normally open in a conventional toilet flush mechanism as the level of water 30 started dropping as the water was discharged through flush pipe 32. However, in the present invention, the inlet valve 24 will not begin to immediately open due to the presence of the device 10, the inlet valve 24 opening only after the water level closes the flush valve 34. As the water level goes down it effects the lowering of the floats 27 and 43 which are adjusted in a manner to open the inlet valve 24 upon the closing of valve member 34, this then effecting the flow of water through the water inlet filler pipe 31 to refill the water compartment 22 to the preselected level, this level then closing the inlet valve 24 with the toilet now being ready for another flushing operation.

There is thus provided a novel adjustable device for connection to a conventional toilet flush mechanism without requiring any alteration or modification of the flush mechanism and which operates in conjunction therewith in a manner to reduce the amount of water utilized during each flushing of the toilet, this amount of water for flushing operation being specifically adjustable for the specific water pressure and area in which the water tank is located to thus provide a great water savings and conservation of natural water elements.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A water saver device intended for use with a conventional toilet flush tank including a water inlet valve controllable by a support rod having a float connected to one end thereof, the device comprising, in combination:

a connector member adapted to be readily mounted to the support rod in a position adjacent the float, the connector member comprising;

an elongated solid body member having a top end and a bottom end and parallel side surfaces;

an open faced channel defining slot extending through one of the side surfaces and opening out of each of the adjacentmost side surfaces intermediate the top and bottom ends of the connector;

a threaded bore extending through the top end in communication with a side wall of the slot;

a threaded cylindrically shaped set screw threadedly received in the threaded bore for rotation about its axis between a position spaced from the slot and a position projecting into the slot to engage and retain the connector to the float support rod passing through the slot; and an interiorly threaded cylindrical bore extending upward through the bottom end and adapted to receive one end of the rod securely therein;

a rod mounted to the connector member and projecting outwardly therefrom to extend vertically into a water level of a toilet tank, the rod provided with screw threads on both ends thereof, one end of the rod being threadedly received in the bottom end threaded bore of the connector, the opposite end of the rod being connected to the float body member;

a float body member affixed to the projecting free end of the rod and extending therefrom, the float body member comprising a box-like rectangularly configured float housing having a flat top surface, a flat bottom surface, vertical side wall surfaces, and vertical front and back end surfaces, a washer member having an aperture in its center secured in a flat manner on the top surface adjacent the float member back end, a nut having a threaded aperture in vertical axial alignment with the aperture of the washer and affixed in a flat manner on the bottom surface of the float member, the free end of the rod extending through the washer aperture and being threadedly received in the nut to secure the float member to the rod; and a plurality of compensating weight members removably associated with the float body member for selective attachment and detachment therefrom to vary the floatation and buoyancy characteristics of the body member selectively by an individual to compensate for local water pressure and toilet flushing requirements.

2. The water saver device as set forth in claim 1 wherein the float member and weight members comprise:

a plurality of vertically extending recesses disposed in the float member top surface adjacent the front end wall surface thereof; and an elongated solid cylindrically shaped weight member associated with each of the recesses, each weight member adapted to be inserted into and removed from one of the recesses to vary the overall weight and floatation and buoyancy characteristics of the float member.

* * * * *